US006464447B2

(12) United States Patent
Dupuy et al.

(10) Patent No.: US 6,464,447 B2
(45) **Date of Patent: *Oct. 15, 2002**

(54) DUAL FUNCTION INBOARD BARRIER/ BRIDGEPLATE ASSEMBLY FOR WHEELCHAIR LIFTS

(75) Inventors: James Robert Dupuy; Alfred L. Budd; James R. Pierrou; Barry E. Wolff, all of Winamac, IN (US)

(73) Assignee: The Braun Corporation, Winamac, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/866,198

(22) Filed: May 25, 2001

(65) Prior Publication Data

US 2001/0031195 A1 Oct. 18, 2001

Related U.S. Application Data

(63) Continuation of application No. 09/295,066, filed on Apr. 20, 1999, now Pat. No. 6,238,169.

(60) Provisional application No. 60/083,894, filed on May 1, 1998, and provisional application No. 60/093,483, filed on Jul. 20, 1998.

(51) Int. Cl.[7] ..... A61G 3/08

(52) U.S. Cl. ..... 414/546; 414/921

(58) Field of Search ..... 414/546, 921

(56) References Cited

U.S. PATENT DOCUMENTS

| | | | |
|---|---|---|---|
| 4,353,436 A | 10/1982 | Rice et al. | |
| 4,474,527 A | 10/1984 | Risner et al. | |
| 4,534,450 A | 8/1985 | Savaria | |
| 4,671,387 A | 6/1987 | Bourgeois | |
| 5,149,246 A | 9/1992 | Dorn | |
| 5,261,779 A | 11/1993 | Goodrich | |
| 5,556,250 A | 9/1996 | Fretwell et al. | |
| 5,605,431 A | 2/1997 | Saucier et al. | |
| 5,672,041 A | 9/1997 | Ringdahl et al. | |
| 5,806,632 A | 9/1998 | Budd et al. | |
| 5,944,473 A | 8/1999 | Saucier et al. | |
| 6,039,528 A | 3/2000 | Cohn | |
| 6,062,805 A | 5/2000 | Tremblay et al. | |
| 6,238,169 B1 * | 5/2001 | DuPuy et al. | 414/546 |

FOREIGN PATENT DOCUMENTS

| | | |
|---|---|---|
| DE | 3739 267 A1 | 6/1989 |
| EP | 0 774 243 A2 | 5/1997 |
| WO | WO 94/27546 | 12/1994 |

* cited by examiner

*Primary Examiner*—Steven A. Bratlie
(74) *Attorney, Agent, or Firm*—Michael Best & Friedrich

(57) ABSTRACT

A dual function, inboard barrier/bridgeplate assembly for wheelchair lifts having a stowable platform, the barrier being pivotably secured to the inboard end of the lift platform, which barrier is actuated by a link to variously raise the barrier to a safety position and lower it to a bridging position in accordance with the position of the platform. The dual function barrier/bridgeplate system is particularly useful in combination with a parallelogram type lift employing an articulated lever assembly having a sliding block for leveraging the platform from a horizontal transfer orientation to a vertical, or over-vertical stowage position. There is disclosed a barrier assembly in which a spring assist system comprising a gas spring acting on one member of the articulated lever assembly and a lever arm linking a second arm of the articulated lever assembly to the barrier co-operate to actuate the barrier from a raised position when the platform is away from the transfer level and a lowered position to act as a bridge plate at the transfer level. A telescoping push arm is included which actuates the barrier by means of a pivoted link which rotates the barrier in response to the telescoping motion of the push arm. A safety interlock and load detecting system may be employed to prevent the platform from moving to the stowed position when a load greater than a predetermined weight is on the platform. An anti-free fall mechanism is disclosed comprising a pin in the slide block which engages mating slots in the telescoping push arm members to lock their length during the initial stage of deploy of the platform downwardly from the vertical stowed position.

36 Claims, 7 Drawing Sheets

DUAL FUNCTION INBOARD BARRIER/ BRIDGEPLATE ASSEMBLY FOR WHEELCHAIR LIFTS

CROSS REFERENCE TO RELATED APPLICATIONS

This application is a continuation of U.S. patent application Ser. No. 09/295,066 filed Apr. 20, 1999 now U.S. Pat. No. 6,238,169, which is related to Provisional Application Serial No. 60/083,894 filed on May 1, 1998 and having the same title, and is also related to Provisional Application Serial No. 60/093,483 filed on Jul. 20, 1998 entitled "Wheelchair Lift Platform Having Internal Gas Spring Deployment From Stowage Position", the benefit of the filing date of each which was claimed under 35 U.S.C. §119(e).

TECHNICAL FIELD

This application relates to wheelchair lifts having a stowable platform and a dual function safely barrier pivotably secured to the inboard end thereof, which barrier is actuated by a link to variously raise the barrier to a safety position and lower it to a bridging position in synchrony with the position of the platform. More particularly the invention relates to dual parallelogram type lifts employing an articulated lever assembly having a sliding block for leveraging the platform from a horizontal transfer orientation to a vertical, or over-vertical stowage position, in which a spring assist system comprising a gas spring acting on one member of the articulated lever assembly and a lever arm linking a second arm of the articulated lever assembly to the barrier co-operate to actuate the barrier from a raised position when the platform is away from the transfer level to a lowered position to act as a bridge plate at the transfer level. Also disclosed is an anti-free fall assembly comprising a pin on the slide block which engages one of the articulated arms to lock it during the initial stage of deploy from a vertical stowage position.

BACKGROUND ART

Parallelogram type wheelchair lifts are offered by a number of manufacturers, including The Braun Corporation of Winamac, Ind. in its L900 series of lifts, as shown in its U.S. Pat. No. 5,261,779, and by Ricon Corporation of Pacoima, Calif. in its S-series of lifts, as shown in U.S. Pat. No. 4,534,450 and expired U.S. Pat. No. Re 31,178. These lifts employ various mechanisms to cause the platform to move arcuately upward from the horizontal transfer level to a vertical or over-vertical stowage position. One system involves the use of an articulated lever assembly comprising a pair of arms of unequal length pivotably connected to each other at one end, and pivotably connected at their other ends respectively to: a) the vertical lift arm end link, at the bottom end of which is pivotally secured the platform, and b) the inboard end of the platform. As the hydraulic ram in the lifting assembly is actuated, lifting the platform from the ground level toward the transfer level, a sliding block, pivotally secured at the common center of the two arms, comes into contact with the lower arm of the parallelogram. As the lifting continues and the end link approaches the lower arm, the lower longer arm of the lever assembly is pushed downwardly. In turn this causes the outboard end of platform to rotate upwardly to the stowed position.

To prevent platform free fall, a number of strategies are employed as set forth in U.S. Pat. No. 5,806,632 issued Sep. 15, 1998, the disclosure of which is hereby incorporated by reference. These strategies include stud and slot arrangements of the Braun Model L211 U, Ricon's Saucier U.S. Pat. No. 5,605,431 (FIGS. 13–15) and a diagonal spring arrangement across the arms of the articulated lever arm assembly as set forth in the aforesaid U.S. Pat. No. 5,806,632.

The outboard end of the platform typically includes a roll stop safety barrier. A variety of actuation strategies are employed, including cables, chains and levers, with or without gas spring or linear actuator assist. Likewise the inboard end of lift platforms are provided with a variety of strategies for actuating inboard barriers. An example is a cam actuated cable system of Saucier, et al., U.S. Pat. No. 5,605,431 (1997) which was commercially available at least as early as Mar. 16, 1992 as the Ricon Model S 5003. This system employs a bell crank and cable. In that system, the lifting parallelogram actuates a cable, the length of which is controlled by a cam assembly pivoted to the lifting end link or an arm of the parallelogram so that as the platform moves, an interior barrier is raised or lowered by the other end of the cable. The articulated lever arm anti-free-fall assembly is not involved in the inboard barrier actuation.

Cable systems however have a number of serious drawbacks, among them being that the cable is difficult to adjust precisely, thereby requiring frequent readjustments, as it stretches in use and tends to lengthen or shorten with temperature. In addition, a cable can fray or break in use, and has limited strength. The barrier position varies under all these conditions and can become out of synchrony with the platform position. In some cases the barrier could prematurely descend to a near-horizontal position prior to the platform reaching the transfer level, in which case it could impact the side of the vehicle or the sill lip at the entry causing damage to the lift and/or vehicle.

Accordingly, there is a need for an improved positive inboard barrier actuation system that does not have the drawbacks of such cable systems.

THE INVENTION SUMMARY, OBJECTS AND ADVANTAGES

This invention includes the following features, functions, objects and advantages in an improved inboard barrier assembly: An inboard safety barrier/bridgeplate which is directly actuated by the articulated lever arm system of the lift; A safety barrier which does not make use of cables; An inboard safety barrier which is precisely and consistently coordinated with the position of the lift; an inboard safety barrier which has the dual function of use as a bridgeplate in a lowered, generally horizontal position. Other objects and advantages will be evident from the description, drawings and claims.

The dual function, inboard barrier/bridgeplate assembly of the invention comprises a generally rectangular plate pivotally mounted to the platform assembly, preferably by pivots mounted coaxially with the lower push arm pivots, which are located on each side of the inboard edge of the platform. The plate is mounted to the pivots by a side brackets of selected dimensions, which are offset from the pivot axis so that the plate closely abuts the inboard edge of the platform floor when in a horizontal position.

In a typical Braun-type parallelogram-type lift, such as described in aforesaid application Ser. No. 08/843,497, the longer, lower push arm is pivoted to the platform at a location somewhat inboard of the platform pivot which supports the platform from the lifting arm extension of the parallelogram outer link. The distance between these pivots provides a lever arm, such that as the push arm is pressed down, the platform is caused to be rotated upwards to a stowed position. The push arm is braced by the shorter upper brace arm, both of which are coaxially pivoted to the slide block. As the lift is move above the transfer level, the slide block contacts the underside of the lower parallelogram link, and presses down on the push arm, causing upward rotation to the platform. Preferably, a spring assist, such as a gas spring, shown mounted diagonally across the lever arm assembly in the preferred embodiment of this invention, is used to bias the lever arm assembly so that the slide block is maintained at its most upward position in contact with the lower link to prevent free-fall on deployment of the lift platform downwardly from the stowed position.

The rotation of the inboard barrier plate to/from a horizontal bridging position to the vertical barrier position is accomplished by an actuator link spanning between one or both of the barrier plate side brackets and the push (lower) arm of the articulated lever arm assembly. The push arm of the invention, unlike the prior art push arms which are rigid struts, is a telescoping, variable length arm comprising an upper member telescoping over a lower member. The actuator link pivots from the lower portion of the upper member (outer sleeve) of the push arm. Since the actuator link is pivoted to the barrier plate inboard of the push arm pivot, a lever arm exists tending to rotate the barrier plate upon motion of the actuator link.

With the lift at ground level or in transit to the transfer level, the push arm is maintained at its maximum length by the gas spring, since the slide block is not yet in contact with the parallelogram link. The actuator link length is selected so that the barrier plate is rotated to a substantially vertical "barrier" position in this configuration. As the lift approaches the transfer level, the slide block contacts the parallelogram lower link and pushes down on the push arm upper member (outer sleeve), causing it to telescope over the lower member. This in turn pushes down on the actuator link, causing the barrier plate to rotate towards a horizontal "bridge" position. The geometry of the actuator link and its pivot mounting brackets, and the telescoping range of the push arm are selected so that the barrier plate rotates to mate smoothly with the outboard margin of the vehicle floor sill as the lift arrives at the transfer position, with the barrier plate substantially horizontal. The barrier plate may have an inboard lip plate fixed to it and shaped to accommodate a smooth transition from bridge to vehicle floor.

As the lift moves past the transfer level towards the stowed position, the push arm becomes maximally telescoped, and thereafter acts as a rigid strut during stowage. Preferably there is an affirmative locking mechanism to control the precise length of the push arm during motion to storage. The principal embodiment has a stud located on the underside of the slide block adjacent its lower edge. As the lift approaches the stowed position and the lever arm assembly nests between the platform and parallelogram structure, the stud inserts first through a slot provided in the upper member of the push arm, and then continues to insert in a slot located in the upper part of the push arm lower member. The location of these respective slots is selected so that the stud move unencumbered through both slots to fix or pin the push arm upper and lower members to a predetermined telescoped length.

A preferred feature of invention is a safety load interlock system such as disclosed in our prior patent Goodrich, U.S. Pat. No. 5,261,779 issued Nov. 16, 1993 entitled DUAL HYDRAULIC, PARALLELOGRAM ARM WHEELCHAIR LIFT, at col. 12, line 65 to col. 13, line 38, which is incorporated herein by this reference. The interlock system may be mounted on, or adjacent to, the articulated lever arm assembly to detect the presence of a platform load greater than a selected cut-off weight. The interlock system also comprises aspects of the control system for the hydraulic lift cylinders and prevents the platform from raising above the transfer level, e.g., to stowage when a platform load is detected.

The barrier system of the invention may be used on both dual and single parallelogram type lifts. For use with a single parallelogram lift, appropriate modifications readily apparent to one skilled in the art can be made to the barrier and its support structure, the principles of its actuation remaining the same as with the dual parallelogram embodiments described below in detail.

BRIEF DESCRIPTION OF DRAWINGS

The invention is described in more detail in the accompanying drawings, in which:

FIG. 8A shows the intermediate position and FIG. 8B shows the stowed position of the slide block assembly.

DETAILED DESCRIPTION OF THE BEST MODE FOR CARRYING OUT THE INVENTION

The following detailed description illustrates the invention by way of example, not by way of limitation of the principles of the invention. This description will clearly enable one skilled in the art to make and use the invention, and describes several embodiments, adaptations, variations, alternatives and uses of the invention, including what is presently believed to be the best mode of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

All publications and patent applications cited in this specification are herein incorporated by reference as if each individual publication or patent application were specifically and individually indicated to be incorporated by reference.

Figure 6:
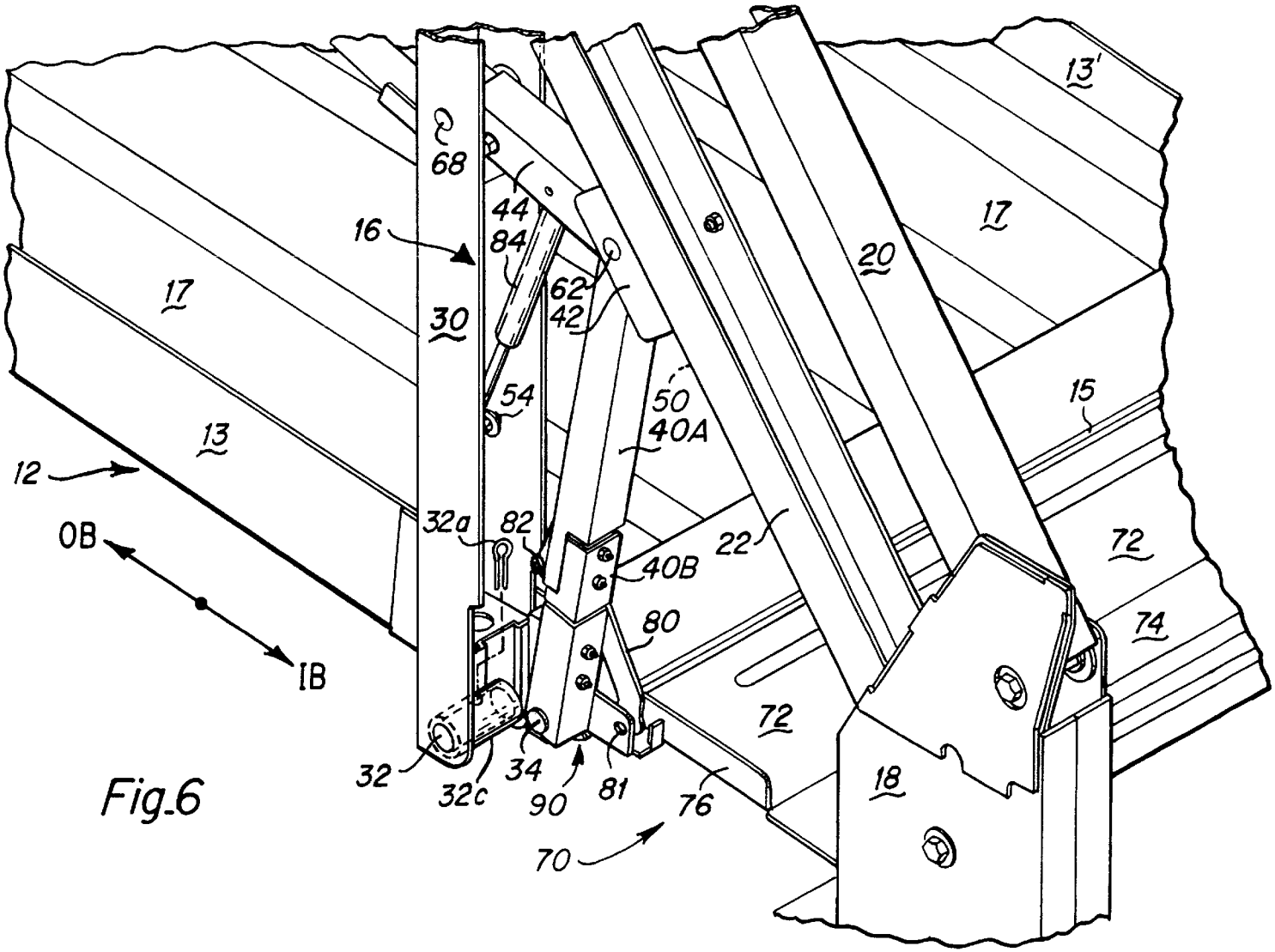
FIG. 6 shows a perspective view of the portion of the inboard barrier assembly of the invention as seen from within a left-hand drive vehicle looking outboard and to the rear.

Further, the vehicles to which the invention relates may be right, left or center drive. While the orientation herein is described by way of example with respect to a left-hand drive, the lift may be mounted in a right-hand drive vehicle, but it is not necessary to convert the parts to their mirror image, although that may be done so easily if desired. Thus, for a right-hand drive vehicle, FIG. 6 is a view to the front and FIG. 7 to the rear. Likewise the lift can be mounted at the rear of a vehicle.

Many of the components and subassemblies of the inboard barrier assembly of the invention and of the typical parallelogram-type wheel chair lift shown in the following figures are preferably disposed substantially symmetrically about a vertical plane of symmetry. This plane is referred to herein as the "centerline" (C/L) of the wheelchair lift. For simplicity and clarity, corresponding parts or elements on each side of the centerline may be referred to by the same label numbers with the label for one side distinguished by a prime symbol.

Figure 1:
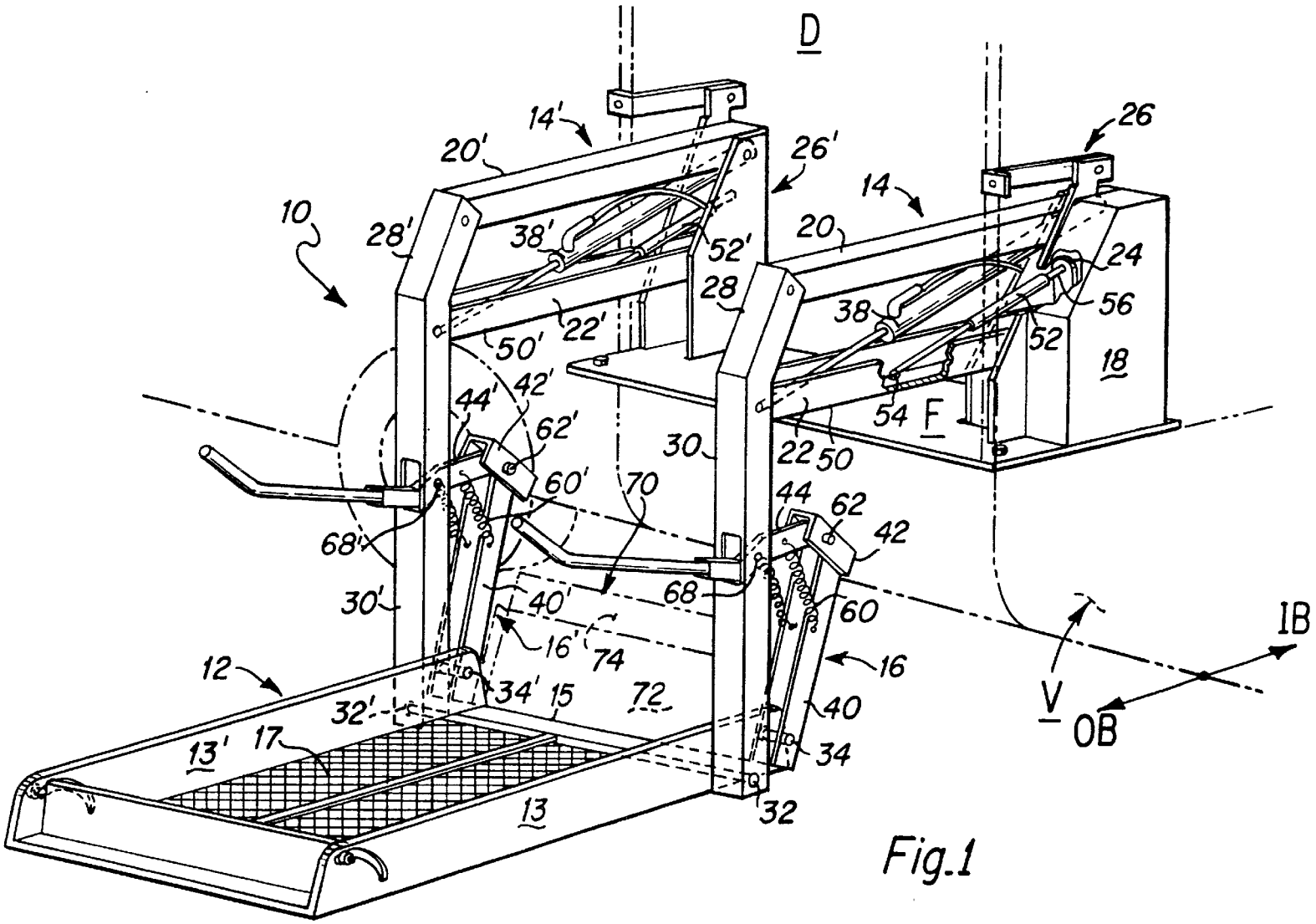
FIG. 1 shows in isometric view the general arrangement of a parallelogram type wheelchair lift, with the inboard barrier of the present invention being shown in phantom.

FIG. 1 is modified from our aforesaid U.S. Pat. No. 5,806,632, the disclosure of which is hereby incorporated by reference. This is an isometric view which shows the general arrangement of a typical vehicle-mounted Braun-type parallelogram wheelchair lift 10 with the platform assembly 12 at ground level. The lift is mounted adjacent right-hand side door D and vehicle floor F with adjacent portions of the vehicle V shown as phantom lines. Note that the inboard/outboard orientation is indicated by Arrows IB/OB, with the inboard direction being towards the upper right corner. This is a wheelchair lift of the type upon which the inboard barrier assembly of the present invention may suitably be installed and employed. The inboard barrier assembly 70 of the present invention has been added as an additional phantom image to show its relationship to a typical wheelchair lift and vehicle. Certain details of the wheelchair lift shown in FIG. 1 differ from the particular lift embodiments which incorporated the inboard barrier of the invention as shown in the following FIG. 2 et seq., particularly with respect to lever arm assembly 16, 16'.

As can be seen in FIG. 1 and also in part in FIGS. 3A–D, The parallelogram lift 10 comprises platform assembly 12, paired parallelogram arm lifting assemblies 14, 14', articulated lever assemblies 16, 16' and hydraulic pump/control assembly 18 as mounted in vehicle V, for example in a side door opening, D. The lift assembly parallelogram comprises top links 20, 20' bottom links 22, 22' rear links 24, 24' (located but not visible in or as part of the stanchions 26, 26'), and the front links 28, 28'. The front link lower extensions 30, 30' are the lifting arms to which the platform assembly 12 is pivoted at 32 adjacent the inboard end, but outwardly of the inboard end a distance sufficient to provide a lever arm by the spacing between pivot rod 32 and the articulated lever arm lower pivot 34, 34'. The lower arm pivot 34, 34' is located adjacent the inboard end of platform side flanges 13, 13'. A bridge plate mounted in the interior of the vehicle is not needed with the present invention, as the inboard barrier assembly 70 of the present invention rotates to form a bridging structure between the platform and the vehicle floor as the lift reaches the transfer level (see FIG. 3C). The lifting hydraulic cylinders are 38, 38'.

Figure 2A:
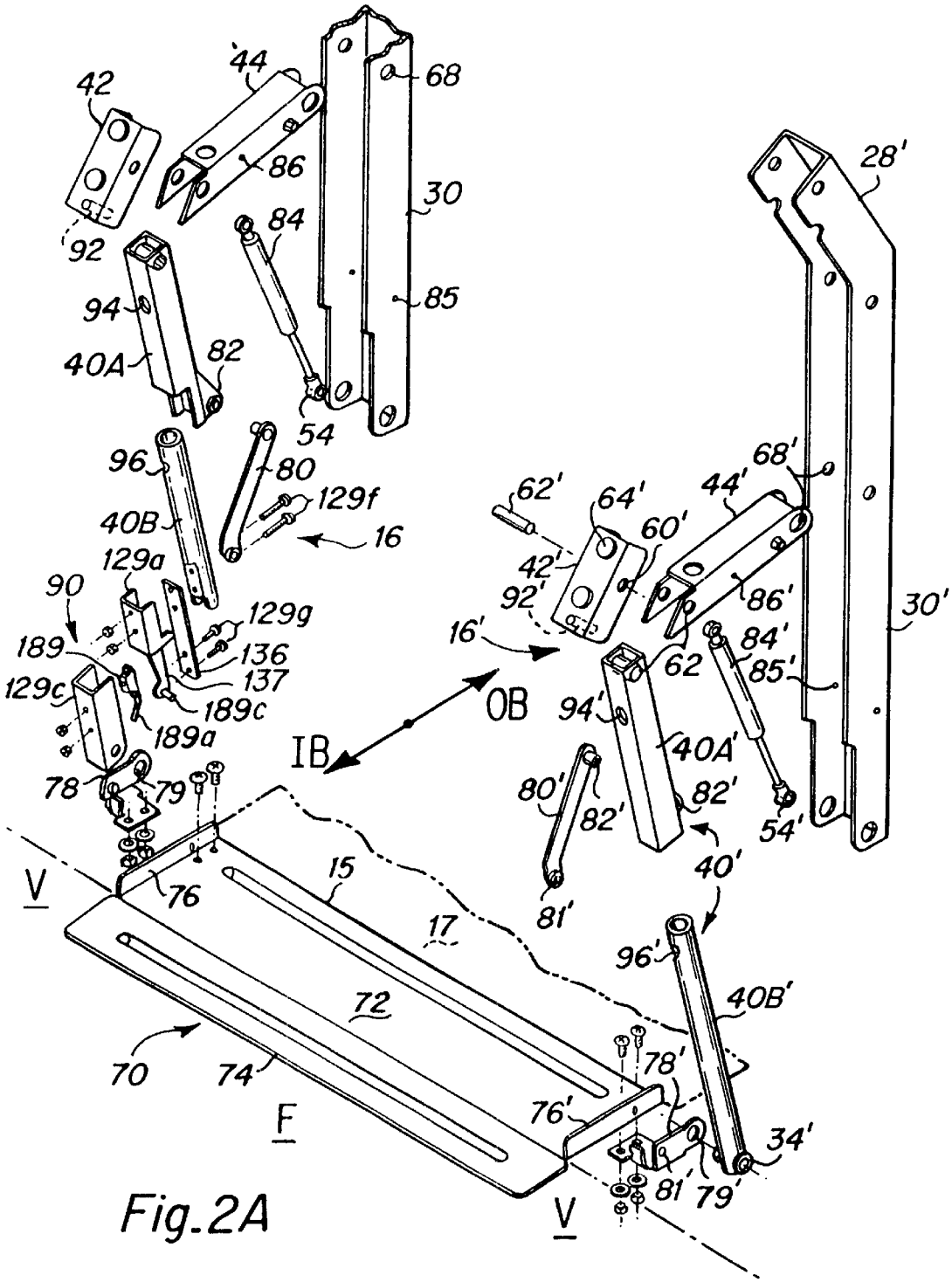
FIGS. 2A and 2B are isometric views of the inboard barrier assembly of the invention, together with adjacent portions of the lift arm and lever arm assembly, FIG. 2A having the components of both the right and left sides of the assembly in exploded view, and FIG. 2B showing the right side components assembled.
Figure 2B:
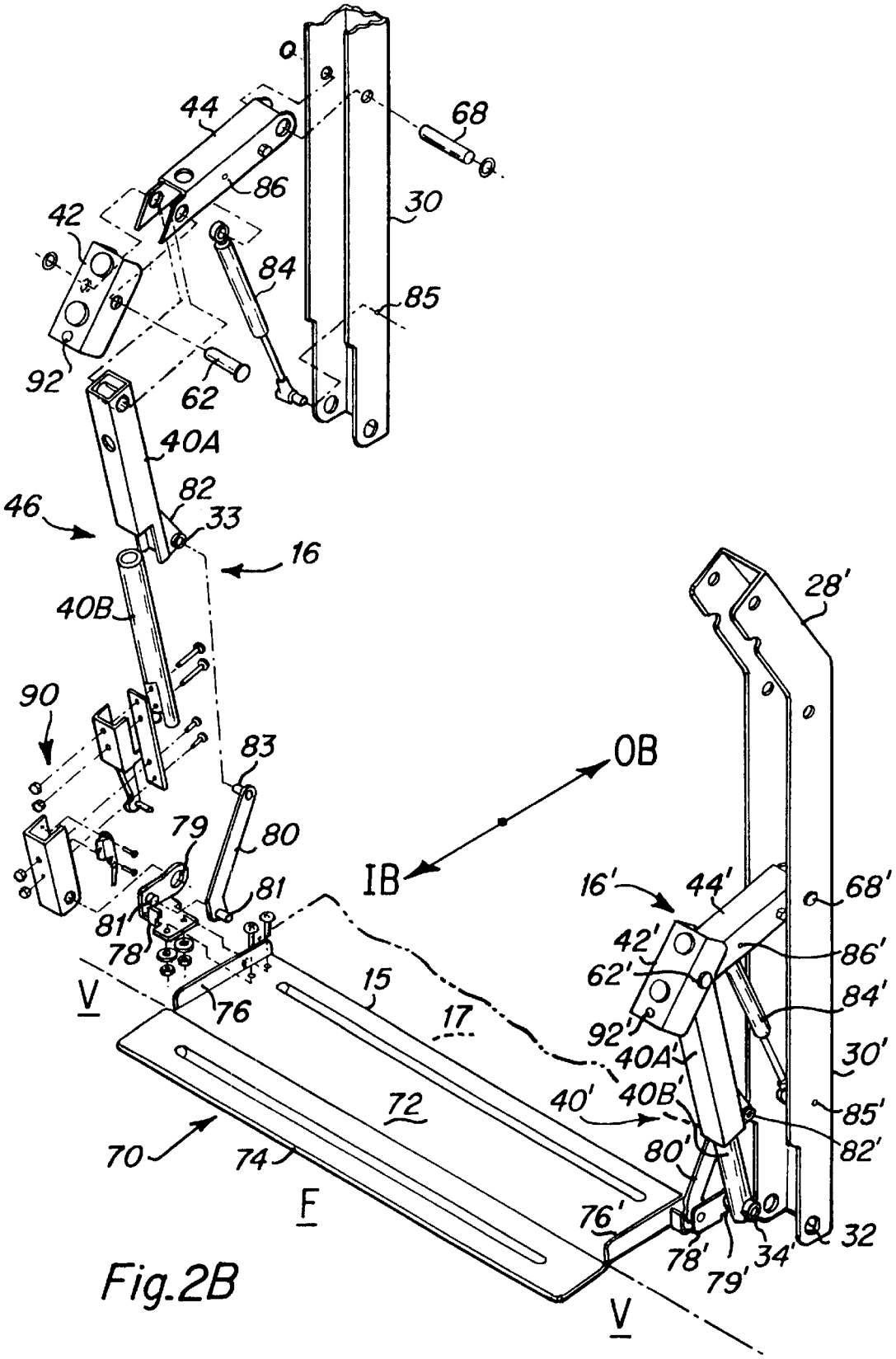

As also seen in FIGS. 2A and 2B and in part in FIGS. 3 A–D, 6 and 7, the articulated lever arm assembly 16, 16' comprises the lower, longer push arm 40, 40' (the push arm in the embodiment of FIG. 2, et seq. comprises an upper sleeve member 40A and a lower member 40B), the pivoting slide block (saddle block) 42, 42', and the short upper brace arm 44, 44'. The brace arm 44, 44' is pivoted at one end at brace arm pivot 68, 68' located in the medial portion of lift arm 30, 30' (front link lower extension) and at its other end at slide block pivot 62, 62. The push arm 40, 40' is coaxially pivoted with brace arm 44, 44' at slide block pivot 62, 62, and is also pivoted at lower pivot 34, 34', located at the inboard end of platform flange 13, 13'.

In FIG. 1, the lift is shown at the ground level with the slide block 42, 42' disengaged from sliding contact with the underside 50, 50' of the lower parallelogram arm 22, 22' (bottom link). The gas spring assist 52, 52' is secured at the outer, rod end 54 to the inside of the lower arm 22 and at the inner, cylinder end 56 to the rear link 24.

Portions of the lower arm and stanchion cover are broken away to show the ends and securement points. The diagonal lever arm closure spring pairs 60, 60' in the FIG. 1 embodiment are not required in the embodiments of FIG. 2 et seq., as the lever arm gas spring (84 in FIG. 2, et seq.) performs a comparable function, in that it acts to bias the two arms 40, 44 (40', 44') of the articulated lever assembly 16, 16' to rotate together to a smaller angle about pivot 62, 62'.

The inboard barrier assembly 70 is shown in FIG. 1 by phantom lines illustrating the barrier plate 72 pivotally mounted adjacent platform inboard edge 15, and showing the barrier lip 74 mounted inboard (and above, in the ground level platform position) the barrier plate 72.

FIGS. 2A and 2B are isometric views of the inboard barrier assembly of the invention 70, together with adjacent portions of the lift arm 30, 30' and lever arm assembly 16, 16'. FIG. 2A shows the components of both the right and left sides of the barrier and lever arm assemblies in exploded view, and FIG. 2B shows the right side components assembled. Where shown in exploded view, the various pivots are indicated by the same label number for both pivot pin and pivot hole in which it is mounted or journaled to a particular component, to clarify the assembled relationship. Note that the inboard/outboard orientation of FIG. 2 is reversed from FIG. 1, as indicated by Arrows IB/OB, with the inboard direction being towards the lower left comer.

FIGS. 2A and 2B show the elongated and generally rectangular inboard barrier plate 72 having barrier side flanges 76, 76' at the right and left sides, and the optional, somewhat narrower barrier lip plate 74 on the inboard margin. The outboard edge of barrier plate 72 is pivoted adjacent the inboard edge 15 of platform floor 17, a portion of which is shown in phantom lines. Barrier 72 is fixedly mounted to barrier brackets 78, 78' which are pivotally connected via apertures 79, 79' to the platform push arm pivot 34, 34' journaled in sides 13, 13' (FIG. 1) of the platform. The axes of pivots 34, 34' lie adjacent and slightly above the inboard edge 15 of the platform floor 17. The geometry of the barrier brackets 78, 78' is selected so that the barrier plate 72, 74 is rotated about pivots 34, 34' to lie parallel to both the platform floor and vehicle floor to form a bridging structure for passage of a wheelchair when the lift is at the transfer level.

In FIGS. 2A, B the lever arm assemblies 16, 16' are mounted in a generally similar manner as in FIG. 1., with each brace arm 44, 44' pivoting at pivot 68, 68' on lift arm 30, 30' at one end and pivoting at pivot 62, 62' on slide block 42, 42' at its other end. However, in this embodiment each push arm 40, 40' comprises a hollow upper sleeve member 40A, 40A' and a lower member 40B, 40B', which telescopingly and slidably nests within upper member 40A, 40A' to form in combination a variable length push arm 40, 40'. Each upper sleeve 40A, 40A' pivotally mounts to the slide block 42, 42' at pivot 62, 62', and the lower member 40B, 40B' pivotally mounts to the platform side (13, 13' in FIG. 1, not shown in FIG. 2) at pivot 34, 34'. The barrier plate assembly 70 is linked to each lever arm assembly 16, 16' by means of barrier actuator links 80, 80'. Each link 80, 80' is pivotally mounted at one end to the barrier bracket 78, 78' at lower link pivot 81, 81', which is located inboard of the barrier pivot 79, 79'. Each link is pivotally mounted at the other end to arm bracket 82, 82' which is fixedly mounted to push arm upper sleeve 40A, 40A' adjacent the lower end of that member. Thus, the actuator pivotal linkage described above geometrically provides that as long as the telescoped length and position of each push arm upper member 40A, 40A' remains constant with respect to lower member 40B, 40B' (i.e., the combined push arm 40, 40' has constant length), the barrier assembly remains at a fixed angle with respect to the push arm 40, 40'. Conversely, as each push arm 40, 40' telescopes, the barrier assembly 70 rotates about barrier pivot 79, 79' (34, 34') relative to the push arm 40, 40'. Thus the barrier rotates downward (towards a horizontal position) as the push arms telescope inward, and rotates upward (towards a more vertical position) as the push arms 40, 40' telescope outward.

As best seen in FIG. 2A, the principal embodiment has a stud 92, 92' located on the underside of each slide block 42, 42' adjacent its lower edge. As the lift approaches the stowed position and the lever arm assemblies 16, 16' begin to nest between the platform and parallelogram structure, each stud 92, 92' inserts through a slot 94, 94' provided in the upper member of the push arm, and thereafter continues its arcuate movement to insert in a slot 96, 96' located in the upper part of the push arm lower member. The location of these respective slots is selected so that the studs 92, 92' move unencumbered through both slots 94, 96 and 94', 96' to fix or pin the push arm upper and lower members in a predetermined telescoped length.

In addition to the elements described above, the left hand portion of FIG. 2A and 2B show and optional load interlock assembly 90 mounted on the lower portion of push arm lower member 40B' adjacent the pivot 79'. The load interlock assembly detects the presence of a load on the platform as the platform is lifted above ground level, and is interconnected to the hydraulic lift controls to prevent motion of the lift towards the stowed position from the transfer level (see FIGS. 3A and 3B) unless the lift is empty. An earlier version of this device is described in our prior patent Goodrich, U.S. Pat. No. 5,261,779 issued Nov. 16, 1993 entitled DUAL HYDRAULIC, PARALLELOGRAM ARM WHEELCHAIR LIFT, at col. 12, line 65 to col. 13, line 38. It is modified as shown herein in FIGS. 2A/B, 6 and 7 to form, as an optional feature, part of the combination of the invention.

Figure 3A:
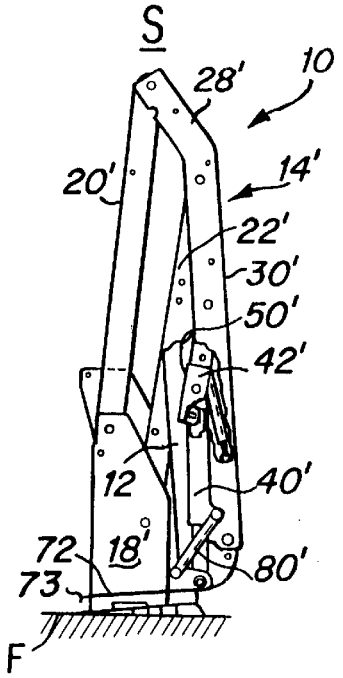
FIGS. 3A–3D are side elevation views of the wheelchair lift and the barrier assembly at different lift positions, FIG. 3A showing the stowed position, FIG. 3B showing the transfer position, FIG. 3C showing an intermediate position, and FIG. 3D showing the approximately ground level position.
Figure 3B:
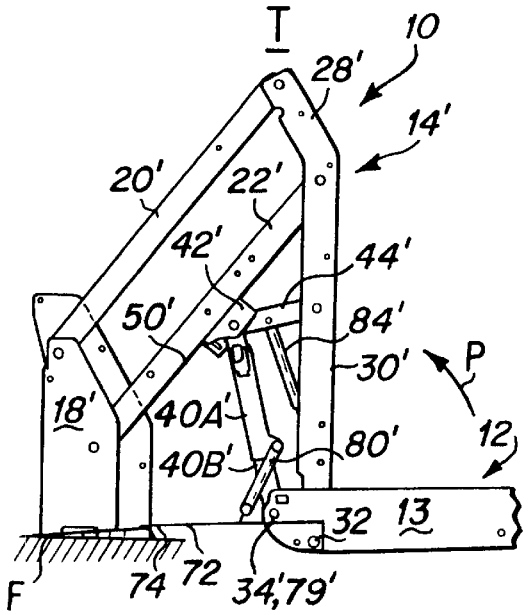
Figure 3C:
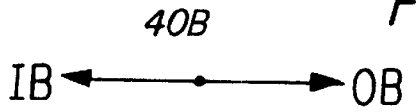
Figure 3C:
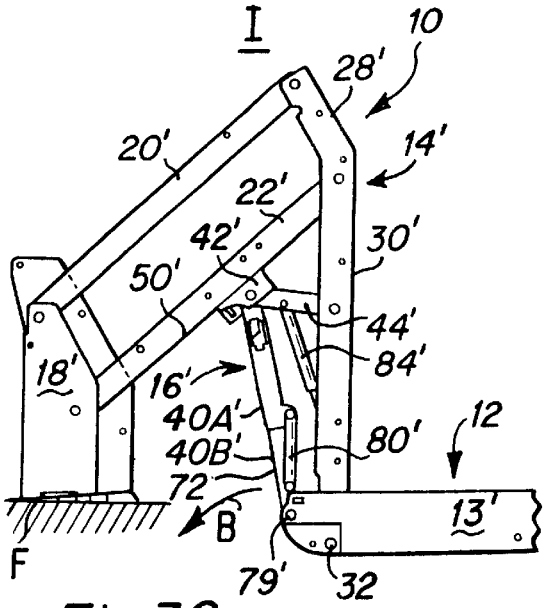
Figure 3D:
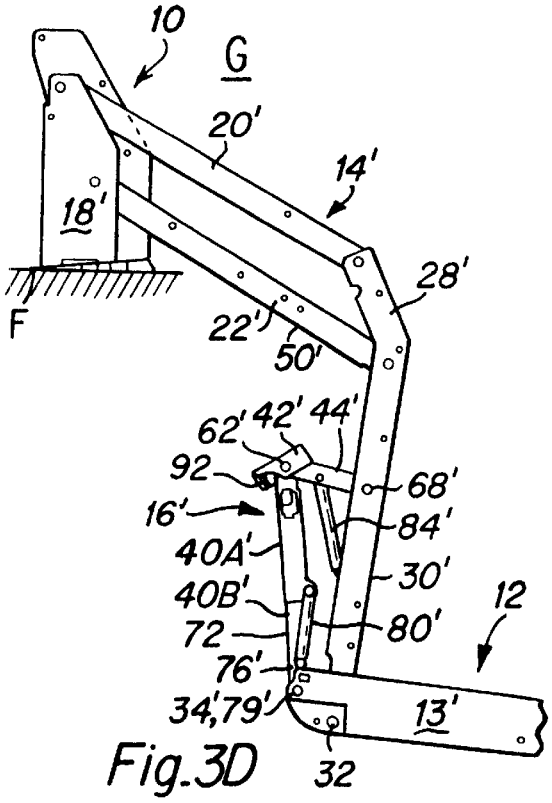

FIGS. 3A–3D are side elevation views of the wheelchair lift and the barrier assembly at different lift positions, with the lifting cylinders and parallelogram gas cylinders (38, 38' and 52, 52' in FIG. 1, respectively) being omitted for clarity. FIG. 3A shows the stowed position S, FIG. 3B shows the transfer position T, FIG. 3C shows an intermediate position I between transfer and ground levels, and FIG. 3D shows the approximately ground lever position G, or slightly below the normal ground level position. In the description below, the prime symbols of FIG. 3 are omitted to simplify the discussion, as the parts correspond.

Turning first to FIG. 3D, it can be seen that with the lift at or near ground level, the lever arm assembly 16 is extended upward by the expansive action of gas spring 84 which bears on brace arm 44. The spring force rotates brace arm upwards about pivot 68. This rotation in turn acts through slide block pivot 62 to pull the sleeve 40A upwards until the actuator link 80 lies substantially parallel to push arm 40B. Further outward telescoping of member 40A relative to member 40B is stopped by the actuator link acting in tension (alternatively there may be provided a mechanical stop limiting rotation on pivot 79). The geometry of the link 80 and barrier bracket 78 is selected so that the barrier plate 72 is rotated by link 80 about axis 79 to a substantially vertical position as the push arm 40A/40B reaches maximum extension, forming an inboard barrier of platform assembly 12. The platform pivot 32 incorporates a mechanical stop (not shown) which restricts further rotation of the platform downward (the opposite of the platform stowage direction of Arrow P in FIG. 3B) after the platform has reached approximately a 90° angle with respect to the lift arm 30.

As the lift is raised, the slide block 42 of the lever arm assembly 16 approaches and makes contact with the underside 50 of lower parallelogram link 22. FIG. 3C shows the lift at the point that this contact has just occurred, at a position somewhat below the transfer level. The push arm 40A/40B remains fully extended, and the barrier plate 72 remains substantially vertical. As lifting progresses further, towards the position shown in FIG. 3B, the pressure exerted by lower link 22 on slide block 42 pushes sleeve 40A to progressively telescope downward over lower member 40B, which in turn causes actuator link 80 to rotate barrier plate 72 towards a horizontal position, as indicated by Arrow B. Compare FIG. 3C to FIG. 3B.

FIG. 3B shows the lift at the transfer lever, with the platform assembly 12 at substantially the same level as the vehicle floor F. The geometry of the actuator link 80 and barrier bracket 78 are selected so that as the lift 10 comes to the transfer level, the barrier plate 72 is substantially horizontal and the barrier lip 74 sufficiently overlaps the outboard edge of vehicle floor F to form a bridging structure suitable for loading and unloading wheelchairs.

As the lifting continues upward from the level shown in FIG. 3B, the push arm 40A/B is completely telescoped to its minimum length, and there after acts as a rigid strut during further movement towards the stowed position S shown in FIG. 3A, as described in our application Ser. No. 08/843,497. The pressure of the slide block 42 on the underside 50 of lower parallelogram arm 22 exerts a downward force through push arm 40A/B and pivot 34 upon the side flange 13 of the platform assembly 12 at a position inboard of the platform pivot. This results in rotation of the platform assembly upwards in the direction of Arrow P. The angular position of the barrier plate 72 relative to the push arm 40A/B does not change as the lift approaches the stowed position shown in FIG. 3A, and the barrier plate is raised somewhat above, but generally parallel to, the vehicle floor as the lever arm assembly 16 moves to a nested position between the lower parallelogram link and platform assembly 12. In the stowed position S, the platform assembly 12 is slightly over-vertical, with plate 72 being essentially horizontal and close to the vehicle floor and transom plate F. The lip 73 of the plate 72 may be rolled or covered with a safety plastic beading as a shin guard.

Figure 4:
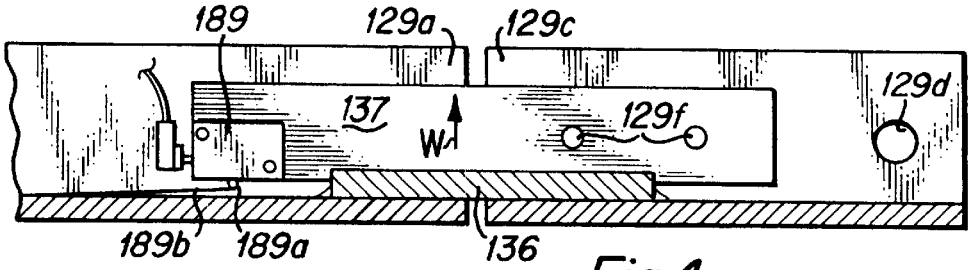
FIG. 4 shows an example of a load sensing switch of the safely interlock system.
Figure 5:
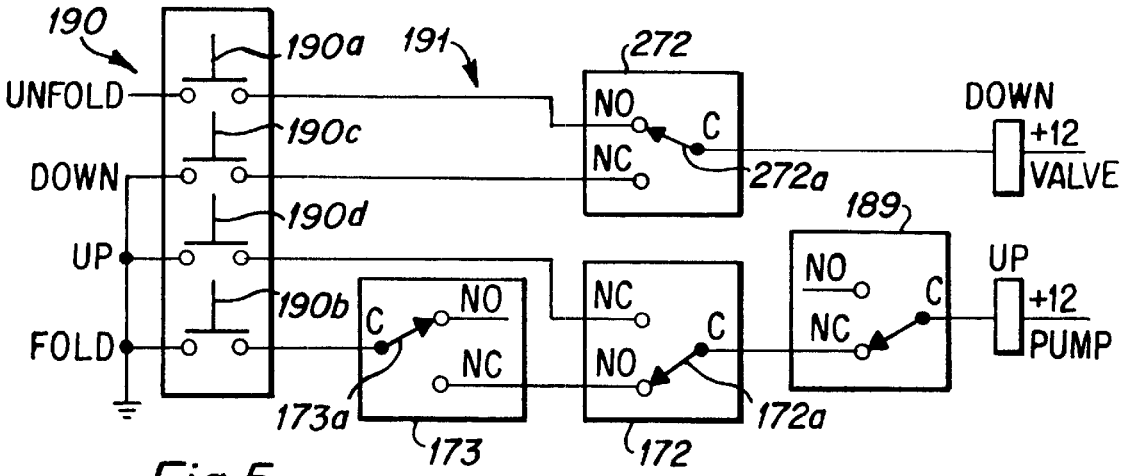
FIG. 5 shows a schematic diagram of an exemplary microswitch wiring of the interlock system.

FIGS. 4 and 5 are from our aforesaid patent, Goodrich, U.S. Pat. No. 5,261,779, issued Nov. 16, 1993 entitled DUAL HYDRAULIC, PARALLELOGRAM ARM WHEELCHAIR LIFT. They depict an alternative embodiment of a load sensing assembly that can be used in the invention in place of the load sensor shown in FIGS. 2A/B. FIG. 4 shows a load sensing "disable" switch 189 which can be provided in one of the articulated lever assemblies 129 so that the platform cannot fold closed (stowed) if there is more than a given weight (say 30–80 lbs.) on the platform. FIGS. 2A and 4 disclose an example of a load interlock switch 189 disposed within a first forearm portion 129*a* of one of the articulated lever assemblies 129. The platform end is to the right in FIG. 4 but is not shown. The load interlock switch 189 is shown in its normally closed (N.C.) position and is mounted on flex arm 137 which is pinned (e.g., bolted as with bolts 129*f*) to a second forearm portion 129*c*. The comparable location in FIG. 2A is at the lower end of the inner member 96. A spring plate 136 connects (by welding, bolting, etc.) the two fore arm portions 129*a* and 129*c* together. When a load of sufficient weight is present on the lift, flex arm 137 moves relative to arm portion 129*a* in the direction of Arrow W, thus increasing pressure of wand 189*a* tripping button 189*b* of the load interlock switch to the N.O. position. This causes a discontinuity in the pump solenoid circuit which interrupts platform operation.

In FIG. 2A the parts are similar but reversed in mounting. Both the spring plate 136 and upper forearm 129*a* are secured by fasteners 129*f* to the push arm lower member 40B' (inner telescoping tube). The flex arm 137 is an extension of forearm 129*a* and includes a trip-rod 189*c*. The micro-switch is fastened to a side wall of the lower forearm channel 189*c* to which the spring plate 136 is fastened by bolts 129*g*. When the platform weight flexes the spring plate 136, the trip-rod 189*c* engages the wand 189*a*, tripping it to the open position (see FIG. 5). While the use of a load sensor assembly is preferred, and may be mounted in any convenient place as is easily determined by one skilled in the art, it is an optional feature and need not be used.

FIG. 5 shows schematic diagram of the microswitch wiring to the umbilical control box 190 via cable 191 and the 12V power source, with the switch contacts shown when the lift is in the upper stowed position. As the rocker switch box is toggled to the "unfold" position (i.e., button 190*a* is depressed or "rocked" one way), the hydraulic valve solenoid is released, and the pressure of the platform bridge plate 139, arm spring 168 and springs associated with pivot pins 124, 127 and 129*e* (not shown) pop the lift open past vertical dead center and the lift descends to the transfer level by gravity. As the trigger pin 163 moves arcuately upward it releases, in turn, first the wand of microswitch 173 and then both wands of microswitches 172, 272. The contacts on the upper inner and outer microswitches 172, 272 are spring biased by release of the wand to N.C. Now, the "Down" rocker switch can be activated (i.e., depression of down button 190*c*), permitting the lift to descend to ground level by gravity for loading. Upon loading, the switching is reversed, with power "up" (up button 190*d* depressed to activate the pump solenoid), followed by power "fold" (fold button 190*b* depressed) after unloading at the transfer level, if the load interlock switch 189 remains N.C., indicating no load is on the lift. If there is a load on the lift the load interlock switch 189 is opened to N.O. by the weight, and the "fold" rocker switch is disabled until the load is safely removed (see discussion of FIG. 4 above).

Figure 7:
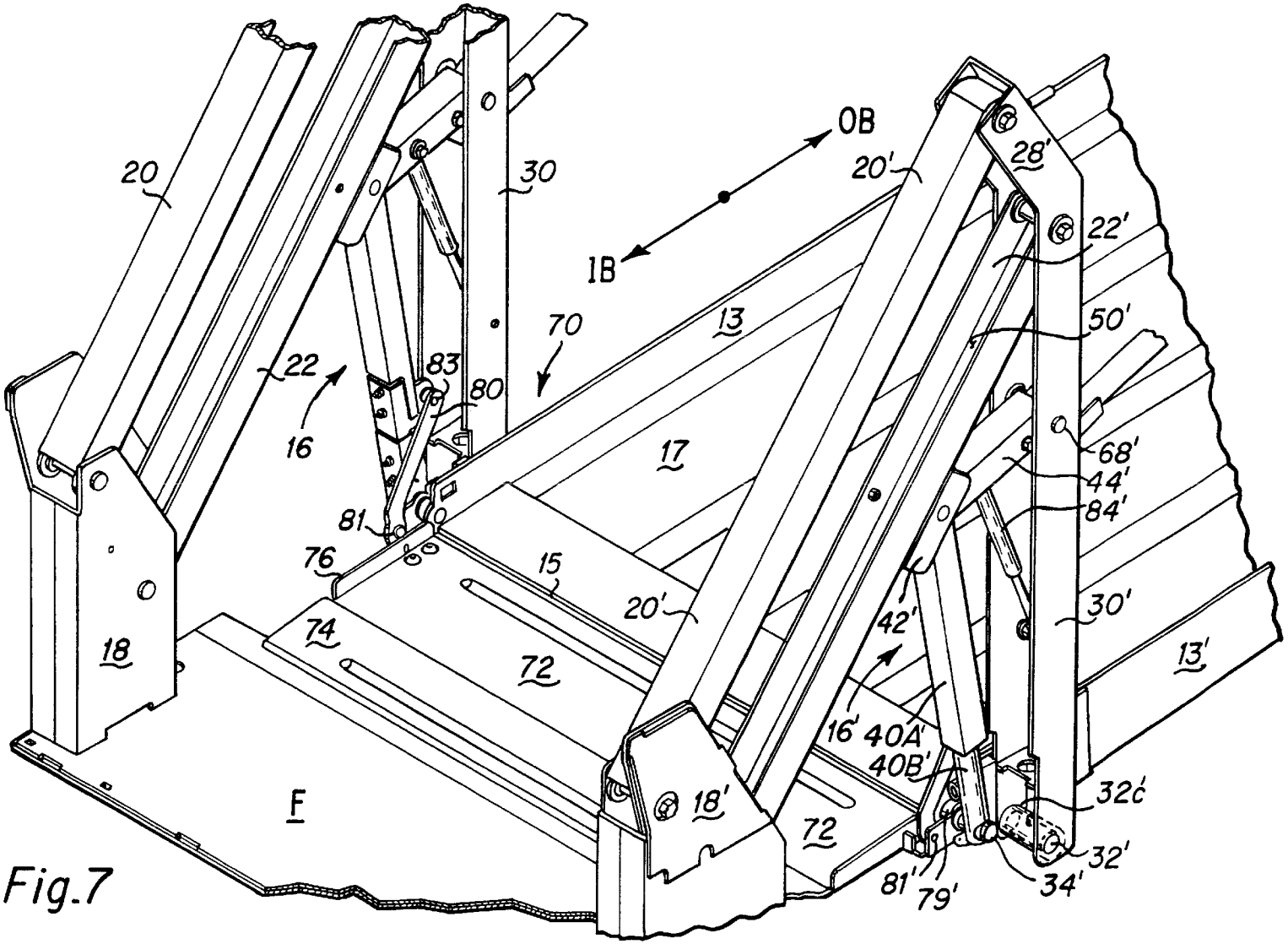
FIG. 7 shows a perspective view of the inboard barrier assembly of the invention as seen from the within a left-hand drive vehicle looking outboard and to the front.

FIG. 6 shows a perspective view of a portion of the inboard barrier assembly 70 of the invention, as assembled and in operation, as seen from within the vehicle looking outboard and to the rear. The platform is at the transfer level with the barrier 72 down in its bridgeplate configuration. The individual components are labelled as in FIGS. 2A/B. As seen in FIGS. 6 and 7, the pivot rod 32 preferably spans the entire width of the platform and is pinned by cotter pin 32*a* to sleeve 32*c* (FIG. 6). FIG. 7 shows a perspective view of the inboard barrier assembly of the invention as seen from within the vehicle looking outboard and to the front. The individual components are labelled as in FIGS. 2A/B. These additional perspective views, upon suitable study will allow one of ordinary skill in the art to understand, make and use the barrier/bridgeplate and actuator assemblies of the invention.

Figure 8A:
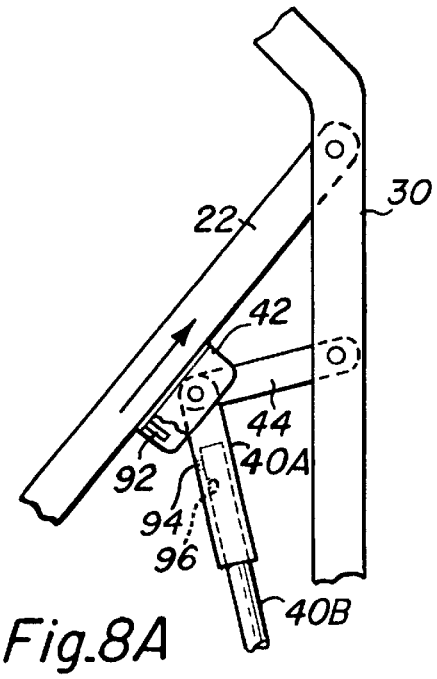
FIGS. 8A and 8B show detail views of the anti-free fall slide block pin-and-slot assembly and the insertion of the pin into the upper and lower arm member slots to lock them for folding and unfolding the lift platform to and from the stowage position.
Figure 8B:
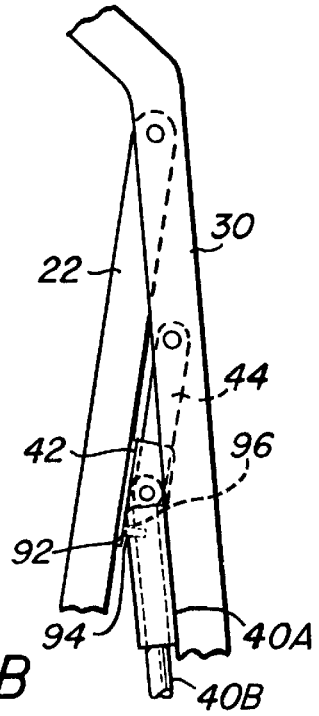

FIGS. 8A and 8B show detail views of the lift as shown in FIGS. 3A and 3B, particularly showing the action of the slide block pin 92 and its insertion into the upper and lower member slots 94 and 96 during lift stowage. Both FIGS. 8A and B show the slide block 42 in contact with lower parallelogram arm 22. Both figures taken in sequence show the pivoting motion of the slide block 42 as it slides up arm 22. They also show the pivotal connection of the slide block 42 to the brace arm 44 and telescoping push arm 40, comprising upper member 40A and lower member 40B.

FIG. 8A shows slide block 42 in an intermediate position, in which pin or stud 92 (shown in the broken portion), located on the inner surface of the slide block, is not yet inserted into upper member slot 94, due to the angle of upper member 40A to slide block 42. Lower member 40B is telescoped downward with respect to upper member 40A in this configuration, and lower member slot 96 does not align with upper member slot 94. As the arm 22 rises, the lower member 40B telescopes into sleeve 40A and the tip of pin 92 approaches hole 94. At the point at which the two slots 94, 96 align, the pin 92 passes through them by the rotation of slide block 42. The upper and lower members are now locked, and the continued lifting of arm 22 causes the platform to fold to the stowed position shown in FIG. 8B since arm 40 is rigid and pushes down on the inboard end of platform which pivots to a vertical orientation as show in FIG. 3.

FIG. 8B shows slide block 42 in the stowed lift position. In this configuration, the two members 40A, B are fully telescoped and locked by pin 92. Upon descent from stowage, since the members are locked, the outward rotation of the platform keeps the slide block in contact with the underside of arm 22, preventing platform free fall.

It is clear that the improved dual-function inboard, safety barrier/bridgeplate of this invention has wide industrial applicability to right- or left-hand drive vehicle-mounted wheelchair lifts, particularly of the parallelogram type. It may also be adapted for non-vehicle mounted lift platforms and elevators. In addition, the absence of cable actuation, positive correspondence of barrier position to lift position, and the transformation from barrier to bridgeplate, makes it ideal for low maintenance operation under a wide variety of load conditions. The load safety interlock is also an important safety feature that makes the inventive, positive, lever-actuated, dual function inboard barrier/bridgeplate particularly attractive for institutional and government run or operated transit systems, particularly those catering to transport of disabled persons.

It should be understood that various modifications within the scope of this invention can be made by one of ordinary skill in the art without departing from the spirit thereof. We therefore wish our invention to be defined by the scope of the appended claims as broadly as the prior art will permit in view of the specification and equivalents, if need be.

What is claimed is:

1. A wheelchair lift of the parallelogram type, comprising:

a platform structure for carrying a passenger;

a lifting mechanism to which said platform structure is pivotally connected adjacent its inboard end, said lifting mechanism including at least one parallelogram structure securable to a vehicle and operable to move said platform structure between a ground level position, a transfer level position, and a vertically stowed position;

an articulated lever assembly connecting said at least one parallelogram structure to said platform, said articulated lever assembly pivoting said platform structure from said transfer level position to said vertically stowed position upon contact with said at least one parallelogram structure; and a plate pivotally connected to the inboard end of said platform structure and movable between a raised safety barrier position and a lowered bridging position, said articulated lever assembly being linked to said plate, wherein contact between said articulated lever assembly and said at least one parallelogram structure lowers said plate to said lowered bridging position.

2. The wheelchair lift of claim 1, further comprising a spring connected between a vertical arm of said lifting mechanism and said articulated lever assembly.

3. The wheelchair lift of claim 1, wherein said articulated lever assembly comprises a shorter arm and a longer arm pivotally connected to each other at one end and at their other ends, respectively, to a vertical lift arm of said parallelogram lifting mechanism and adjacent the inboard end of said platform structure.

4. The wheelchair lift of claim 3, wherein said longer arm is a variable length push arm including an upper sleeve member telescopingly secured to a lower sleeve member.

5. The wheelchair lift of claim 4, wherein said articulated lever assembly is linked to said plate by an actuator link that extends between said plate and said upper sleeve member.

6. The wheelchair lift of claim 1, wherein said articulated lever assembly comprises a pair of arms of unequal length pivotally connected to each other about a common center pivot at one end and at their other ends, respectively, to a vertical lift arm of said lifting mechanism and adjacent the inboard end of the platform structure, and a slide block pivotally secured at said common center pivot.

7. The wheelchair lift of claim 6, wherein said slide block includes a disengageable locking member which releasingly engages one of said pair of arms when said platform structure is in said vertically stowed position.

8. The wheelchair lift of claim 1, wherein said articulated lever assembly contacts a bottom member of said at least one parallelogram structure.

9. The wheelchair lift of claim 1, wherein said articulated lever assembly is linked to said plate by an actuator link.

10. A wheelchair lift, comprising:

a lifting mechanism pivotally connected to a platform structure adjacent an inboard end of said platform structure;

an articulated lever assembly connected with an inboard end of said platform structure and contactable by said lifting mechanism to pivot said platform structure from a generally horizontal transfer level position to a vertically stowed position, said articulated lever assembly including a shorter arm and a longer arm pivotally connected to each other at one end and connected at their other ends, respectively, to a vertical lift arm of said lifting mechanism and to the inboard end of said platform structure, and a slide block secured at the common center of said shorter arm and said longer arm; and a plate coupled to said platform structure at the inboard end of said platform structure, said articulated lever assembly being linked to said plate, wherein said articulated lever assembly moves said plate from a raised safety barrier position to a lowered bridging position when said articulated lever assembly contacts said at least one lifting mechanism.

11. The wheelchair lift of claim 10, wherein said lifting mechanism includes a parallelogram structure having a bottom member and said articulated lever assembly contacts said bottom member.

12. The wheelchair lift of claim 10, wherein said longer arm is a variable length push arm including an upper sleeve member telescopingly secured to a lower sleeve member.

13. The wheelchair lift of claim 10, wherein said articulated lever assembly is linked to said plate by an actuator link.

14. The wheelchair lift of claim 10, wherein said slide block includes a disengageable locking member which releasingly engages said longer arm during an initial deploy stage of said platform structure downwardly from said vertical stowed position.

15. A method for providing access to a vehicle from a platform structure of a wheelchair lift, comprising:

providing a lifting mechanism to raise and lower the platform structure between a ground level position and a transfer level position, the lifting mechanism including at least one parallelogram structure having a vertical arm pivotally coupled toward an inboard end of the platform structure and an articulated lever assembly coupled between the vertical arm of the parallelogram structure and an inboard end of the platform structure;

providing a plate pivotally coupled at the inboard end of the platform structure;

raising the platform structure with the at least one lifting mechanism to the transfer level position wherein the articulated lever assembly contacts the parallelogram structure; and moving the plate from a raised safety barrier position oriented transversely to said platform structure to a lowered bridging position extending between said platform structure and the vehicle by the contact of the articulated lever assembly with the parallelogram structure.

16. The method of claim 15, further comprising:

lowering the platform structure from the horizontal transfer level position to the ground level position; and moving the plate from the lowered bridging position to the raised safety barrier position by removing contact between the articulated lever assembly and the parallelogram structure as the platform structure is lowered from the transfer level position to a ground level position.

17. The method of claim 15, wherein the plate remains generally in the lowered bridging position as the platform structure is pivoted from the horizontal transfer level position to a vertical stowed position.

18. A wheelchair lift, comprising:

a platform structure for carrying a passenger;

a lifting mechanism to which said platform structure is pivotally connected adjacent its inboard end, said lifting mechanism including at least one parallelogram structure securable to a vehicle and operable to move said platform structure between a ground level position, a transfer level position, and a vertically stowed position;

an articulated lever assembly connected to said lifting mechanism, said articulated lever assembly engageable with a bottom member of said at least one parallelogram structure for pivoting said platform structure from said transfer level position to said vertically stowed position; and a plate coupled to said platform structure at the inboard end of said platform structure, said plate being further coupled to said articulated lever assembly wherein said articulated lever assembly is engageable with said at least one parallelogram structure to variously raise and lower said plate between a raised safety barrier position and a lowered bridging position.

19. The wheelchair lift of claim 18, wherein said articulated lever assembly comprises a shorter arm and a longer arm pivotally connected to each other at one end and at their other ends, respectively, to a vertical lift arm of said lifting mechanism and adjacent the inboard end of said platform structure.

20. The wheelchair lift of claim 19, further comprising a slide block secured at the common center of said shorter arm and said longer arm, said slide block engageable with and moveable along said bottom member of said at least one parallelogram structure.

21. The wheelchair lift of claim 19, wherein said longer arm is a variable length push arm including an upper sleeve member telescopingly secured to a lower sleeve member.

22. The wheelchair lift of claim 21, wherein said articulated lever assembly is coupled to said plate by an actuator link that extends between and is pivotally coupled to said plate and said upper sleeve member.

23. The wheelchair lift of claim 18, wherein said articulated lever assembly is coupled to said plate by an actuator link that extends between said plate and said articulated lever assembly.

24. A wheelchair lift, comprising:

a platform structure for carrying a passenger;

a lifting mechanism pivotally connected to said platform structure adjacent an inboard end of said platform structure;

an articulated lever assembly connected with an inboard end of said platform structure, said articulated lever assembly including a shorter arm and a longer arm pivotally connected to each other at one end and connected at their other ends, respectively, to a vertical lift arm of said lifting mechanism and to the inboard end of said platform structure, said articulated lever assembly engageable with a member of said lifting mechanism to pivot said platform structure from a generally horizontal transfer level position to a vertically stowed position; and a plate pivotally connected to the inboard end of said platform structure and coupled to said articulated lever assembly, wherein said plate is variously raised and lowered between a raised safety barrier position and a lowered bridging position in response to engagement of said articulated lever assembly with said member of said lifting mechanism.

25. The wheelchair lift of claim 24, further comprising a slide block secured at the common center of said shorter arm and said longer arm, wherein said slide block is engageable with said member of said lifting mechanism to pivot said platform structure, said slide block further moveable along said member as said bridge plate is variously raised and lowered between said raised safety barrier position and said lowered bridging position.

26. The wheelchair lift of claim 25, further comprising a gas spring connected between said vertical lift arm and one of said shorter arm and the common center of the longer arm and shorter arm.

27. The wheelchair lift of claim 24, wherein said longer arm is a variable length push arm including an upper sleeve member telescopingly secured to a lower sleeve member.

28. The wheelchair lift of claim 27, wherein said articulated lever assembly is coupled to said plate by an actuator link that extends from said plate and is pivotally coupled to said upper sleeve member.

29. The wheelchair lift of claim 28, wherein said actuator link is pivotally coupled to said plate.

30. The wheelchair lift of claim 24, wherein said lifting mechanism includes at least one parallelogram structure, and said member is a bottom member of said at least one parallelogram structure.

31. A wheelchair lift, comprising:

a platform structure for carrying a passenger;

a lifting mechanism to which said platform structure is pivotally connected adjacent its inboard end, said lifting mechanism including at least one parallelogram structure securable to a vehicle and operable to move said platform structure between a ground level position, a transfer level position, and a vertically stowed position;

an articulated lever assembly connected to said lifting mechanism, said articulated lever assembly disengaged with said at least one parallelogram structure when said platform structure is at said ground level position, said articulated lever assembly engageable with said at least one parallelogram structure to pivot said platform structure from said transfer level position to said vertically stowed position;

a plate coupled to said platform structure at the inboard end of said platform structure; and an actuator assembly extending between said articulated lever assembly and said plate, said actuator assembly variously raising and lowering said plate between a raised safety barrier position and a lowered bridging position in accordance with the engaged position of said articulated lever assembly relative to said at least one parallelogram structure.

32. The wheelchair lift of claim 31, wherein said articulated lever assembly comprises a shorter arm and a longer arm pivotally connected to each other at one end and at their other ends, respectively, to a vertical lift arm of said lifting mechanism and adjacent the inboard end of said platform structure.

33. The wheelchair lift of claim 32, further comprising a slide block secured at the common center of said shorter arm and said longer arm, said slide block engageable with and moveable along a bottom member of said at least one parallelogram structure.

34. The wheelchair lift of claim 32, wherein said longer arm is a variable length push arm including an upper sleeve member telescopingly secured to a lower sleeve member.

35. The wheelchair lift of claim 31, wherein said actuator assembly includes an actuator link that extends between and is pivotally coupled to said plate and said articulated lever assembly.

36. The wheelchair lift of claim 31, wherein said actuator assembly contacts a bottom member of said at least one parallelogram structure as said plate is variously raised and lowered between a raised safety barrier position and a lowered bridging position.

* * * * *